US008230895B2

(12) United States Patent
Leahy

(10) Patent No.: US 8,230,895 B2
(45) Date of Patent: Jul. 31, 2012

(54) SLIDING BLIND SYSTEM

(76) Inventor: William Colin Leahy, Engadine (AU)

( * ) Notice: Subject to any disclaimer, the term of this patent is extended or adjusted under 35 U.S.C. 154(b) by 47 days.

(21) Appl. No.: 12/999,662

(22) PCT Filed: Aug. 7, 2009

(86) PCT No.: PCT/AU2009/001016

§ 371 (c)(1),
(2), (4) Date: Dec. 17, 2010

(87) PCT Pub. No.: WO2010/019987

PCT Pub. Date: Feb. 25, 2010

(65) Prior Publication Data

US 2011/0100563 A1 May 5, 2011

(30) Foreign Application Priority Data

Aug. 18, 2008 (AU) ..... 2008904218

(51) Int. Cl.
*E06B 3/32* (2006.01)

(52) U.S. Cl. ..... 160/102; 160/107; 160/184

(58) Field of Classification Search ..... 160/96, 160/101, 102, 107, 172 R, 99, 104, 184, 197, 160/115, 168.1 R, 178.1 R, 902
See application file for complete search history.

(56) References Cited

U.S. PATENT DOCUMENTS 4,341,254 A * 7/1982 Schaller et al. ..... 160/172 R
4,457,106 A * 7/1984 Forquer ..... 49/158
4,538,662 A * 9/1985 Tomita ..... 160/107
4,877,076 A * 10/1989 Komori et al. ..... 160/107
5,000,242 A * 3/1991 Coddens ..... 160/107
6,688,372 B1 * 2/2004 Nien ..... 160/172 R
6,705,379 B1 * 3/2004 Nien ..... 160/172 R
6,860,064 B2 * 3/2005 Bakalar ..... 49/127
6,892,783 B1 * 5/2005 Comeau et al. ..... 160/126
7,128,120 B2 * 10/2006 Orbeck et al. ..... 160/89
7,730,671 B2 * 6/2010 Zab et al. ..... 49/409
2005/0173079 A1 8/2005 Orbeck et al.

FOREIGN PATENT DOCUMENTS

JP 2007016383 A 1/2007

OTHER PUBLICATIONS

International Search Report and Written Opinion dated Sep. 15, 2009 in corresponding International Application No. PCT/AU2009/001016, 6 pages.

* cited by examiner

*Primary Examiner* — David Purol
(74) *Attorney, Agent, or Firm* — Maier & Maier, PLLC

(57) ABSTRACT

A sliding blind system (10) for covering a sliding first panel (12) located adjacent to a fixed second panel (14), the system comprising: at least one blind support bracket (11) mounted to an upper, generally horizontal edge of the first panel (12); a first blind (16) secured to the blind support bracket (11); a vertically extending first guide member (20) securable to a generally vertical first side edge of the first panel (12), and a second vertically extending guide member (22) securable to an opposing generally vertical second edge of the first panel (12), wherein the first blind is located generally between the first and second guide members; and a header panel (24) mountable to a fixed structure above the second panel (14); and a second blind (18) secured to the header panel (24), wherein the second blind (18) is mounted in front of the first blind (16) such that when the first panel (12) slides in front of the second panel (14), the first blind (16) slides behind the second blind (18).

5 Claims, 6 Drawing Sheets

SLIDING BLIND SYSTEM

RELATED APPLICATIONS

This application claims priority, under 35 U.S.C. §119, to Australian Patent Application No.: 2008904218, filed on Aug. 18, 2008, the disclosure of which is incorporated by reference herein in its entirety.

FIELD OF THE INVENTION

The present invention relates to a sliding blind system. In particular, the present invention relates to a sliding blind mounting system for venetian blinds.

BACKGROUND OF THE INVENTION

Venetian blinds have increased in popularity in recent years on account of current interior design trends and the superior light blocking and transmission characteristics that they offer. However, venetian blinds are generally not practical when mounted in front of a sliding door or window. In the instance of a sliding door having a sliding panel and an adjacent fixed panel, two separate venetian blinds would typically be mounted side by side to the architrave around the door way. However, a problem with this particular blind mounting arrangement is that the blind over the sliding panel needs to be rolled up every time someone wishes to open the door. This is known to quickly wear out the blind mechanism in locations where there is a high level of traffic.

A further disadvantage of the above noted venetian blind mounting system is that when the blind is closed, and the door is open, the blind may be damaged if a significant breeze passes through the doorway, causing the blind to move and impact with nearby objects such as the door jam.

Timber, glass and other louvers are popular window and door coverings in modern buildings. Louvers can readily be mounted in sliding application, as the louver is supported in a rigid frame, and the frame may be track mounted. However, a disadvantage of louvers is that they are typically expensive and require custom manufacture to size and professional installation. Whilst venetian blinds provide a far more cost effective alternative to louvers, they are generally not suitable to sliding applications, as the weight of the venetian blind is supported only by two or more chords, and the blind itself does not have much transverse stiffness. Accordingly, venetian blinds are generally not suitable for mounting in a sliding context, as the base of the blind is prone to swaying.

OBJECT OF THE INVENTION

It is an object of the present invention to substantially overcome, or at least ameliorate at least one of the above disadvantages, or at least to provide a useful alternative.

SUMMARY OF THE INVENTION

In a first aspect, the present invention provides a sliding blind system for covering a sliding first panel located adjacent to a fixed second panel, said system comprising:

at least one blind support bracket mounted to an upper, generally horizontal edge of said first panel;

a first blind secured to said blind support bracket;

a vertically extending first guide member securable to a generally vertical first side edge of said first panel, and a second vertically extending guide member securable to an opposing generally vertical second side edge of said first panel, wherein said first blind is located generally between said first and second guide members; and a header panel mountable to a fixed structure above said second panel; and a second blind secured to said header panel, wherein said second blind is mounted in front of said first blind such that when said first panel slides in front of said second panel, said first blind slides behind said second blind.

The system preferably includes a footer panel mountable to a floor surface adjacent to the first panel and second panels, the footer panel having a downwardly tapering step located adjacent to the first panel when the first panel is closed.

The first and second guide members are preferably formed from sections of 90 degree angle.

The header panel preferably extends above both the first panel and the second panel when the first panel is closed, wherein the header panel has a recess formed on a side which is closest to the panels, the recess permits the first blind to be mounted at the same height as the second blind.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
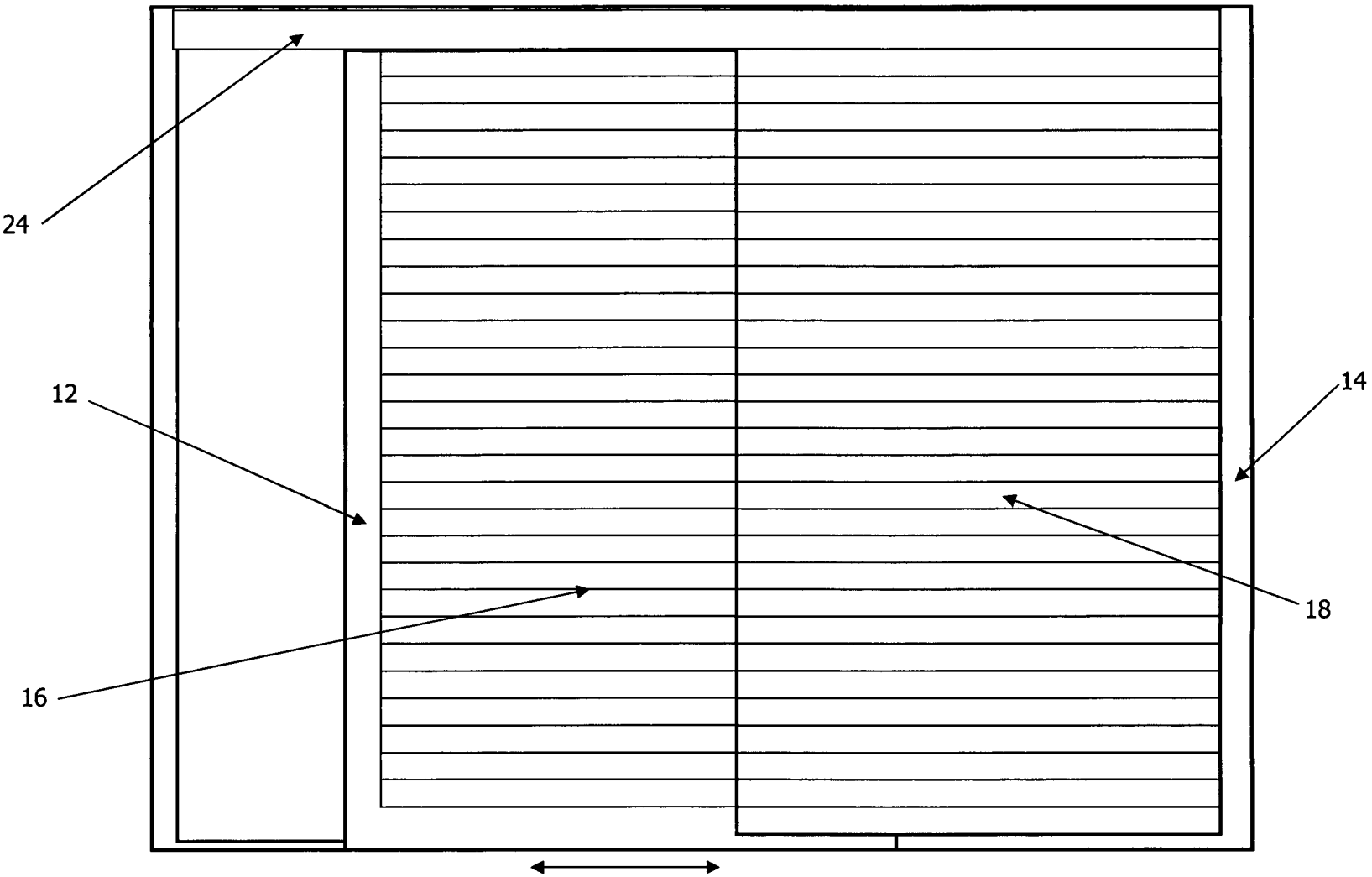
FIG. 1 is a schematic view of the overall sliding blind system.

FIG. 1 shows a sliding blind system 10 which utilises venetian blinds or another similar window covering for covering a sliding first panel 12, such as a glass door, and an adjacent fixed second panel 14. The system 10 may also be used with sliding windows or doors.

The system 10 includes at least one blind support bracket 11 which is mounted to an upper, generally horizontal edge of the sliding panel 12. The blind support bracket 11 may be of the kind which permits the blind to be readily removed for cleaning and maintenance purposes.

The blind support brackets 11 are generally mounted to the upper, horizontal frame of the sliding panel 12. However, in some circumstances, where the upper horizontal frame is not sufficiently large on account of the door jam or other such restrictions, the support brackets may be mounted directly to the glass surface of the sliding panel 12. Such mounting may be effected by double sided tape, suction cups or other suitable adhesives.

A first venetian blind 16 is secured to the blind support bracket 11, and hangs in front of the sliding panel 12, such that the first blind 16 slides with the sliding panel 12. A second similar venetian blind 18 hangs in front of the second, fixed panel 14.

The system 10 can also include at least one blind support bracket mounted to a lower, generally horizontal edge of the sliding panel. Accordingly, in this embodiment, the blind 18 is secured at the top and bottom. By securing the blind 16 at the top and the bottom, swaying of the blind 18 is significantly reduced during movement of the sliding panel 12.

Figure 2:
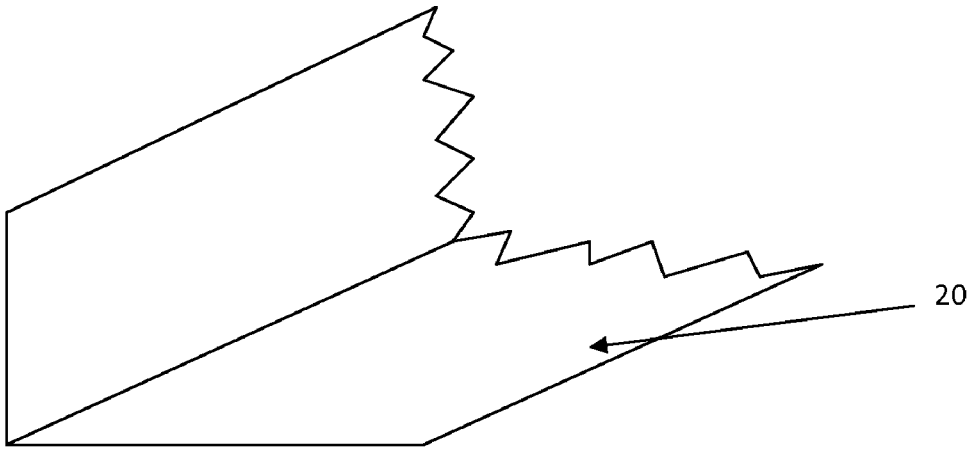
FIG. 2 is a partial perspective view of a guide bracket of the system for mounting to a left hand side of a sliding door panel.
Figure 3:
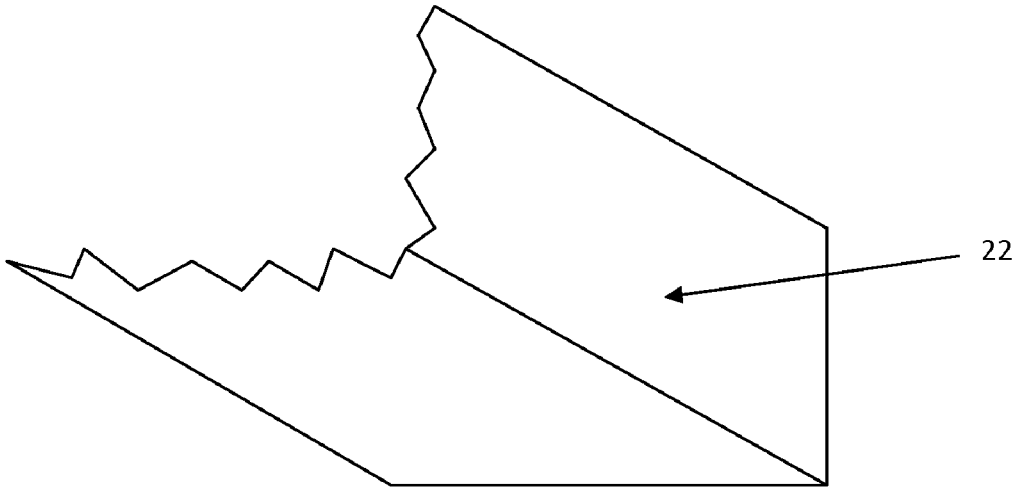
FIG. 3 is a partial perspective view of a guide bracket for mounting to a right hand side of the sliding door panel.

The system 10 includes a vertically extending first guide bracket 20, and a vertically extending second guide bracket 22 shown in FIGS. 2 and 3. The guide brackets 20, 22 are manufactured from an extruded 90 degree angle extrusion of powder coated aluminium, plastic, or another suitable material. The guides 20, 22 are secured to the two opposing generally vertical edges of the sliding panel 12 with double sided tape or other suitable fasteners such as screws, and the first blind 16 hangs generally between the two guide brackets 20, 22. Accordingly, the guide brackets 20, 22 prevent the blind 16 from swaying from side to side when the door panel 12 slides on account of the momentum caused by the sliding door 12, and its rapid deceleration at the start or end of an opening or closing movement.

Figure 5:
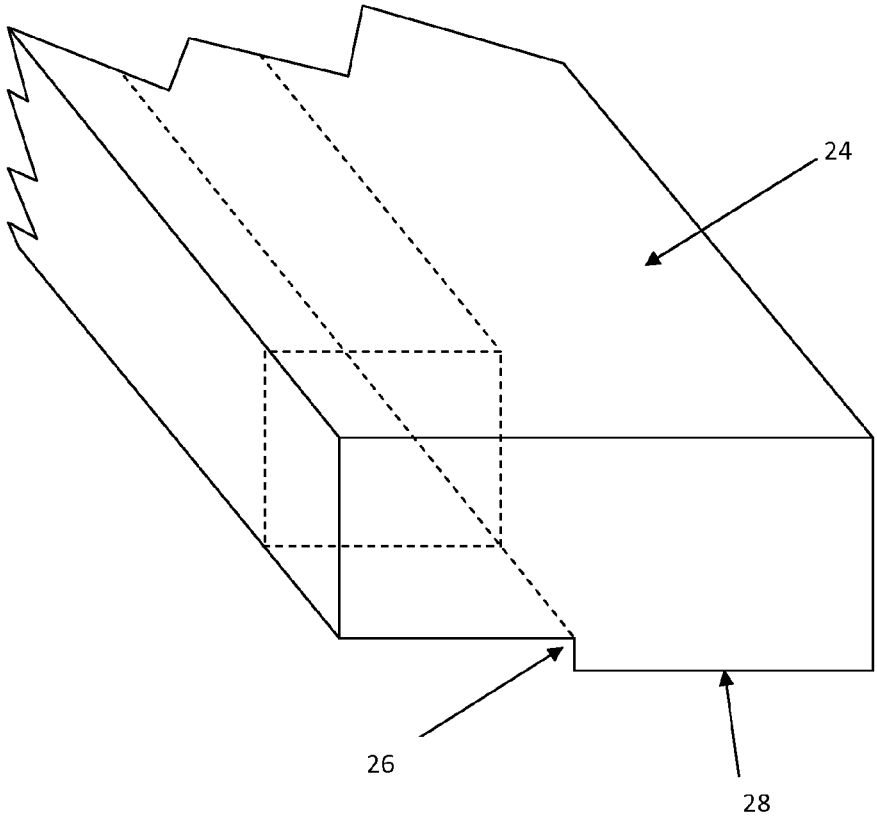
FIG. 5 is a partial perspective view of a header plate of the system.
Figure 7:
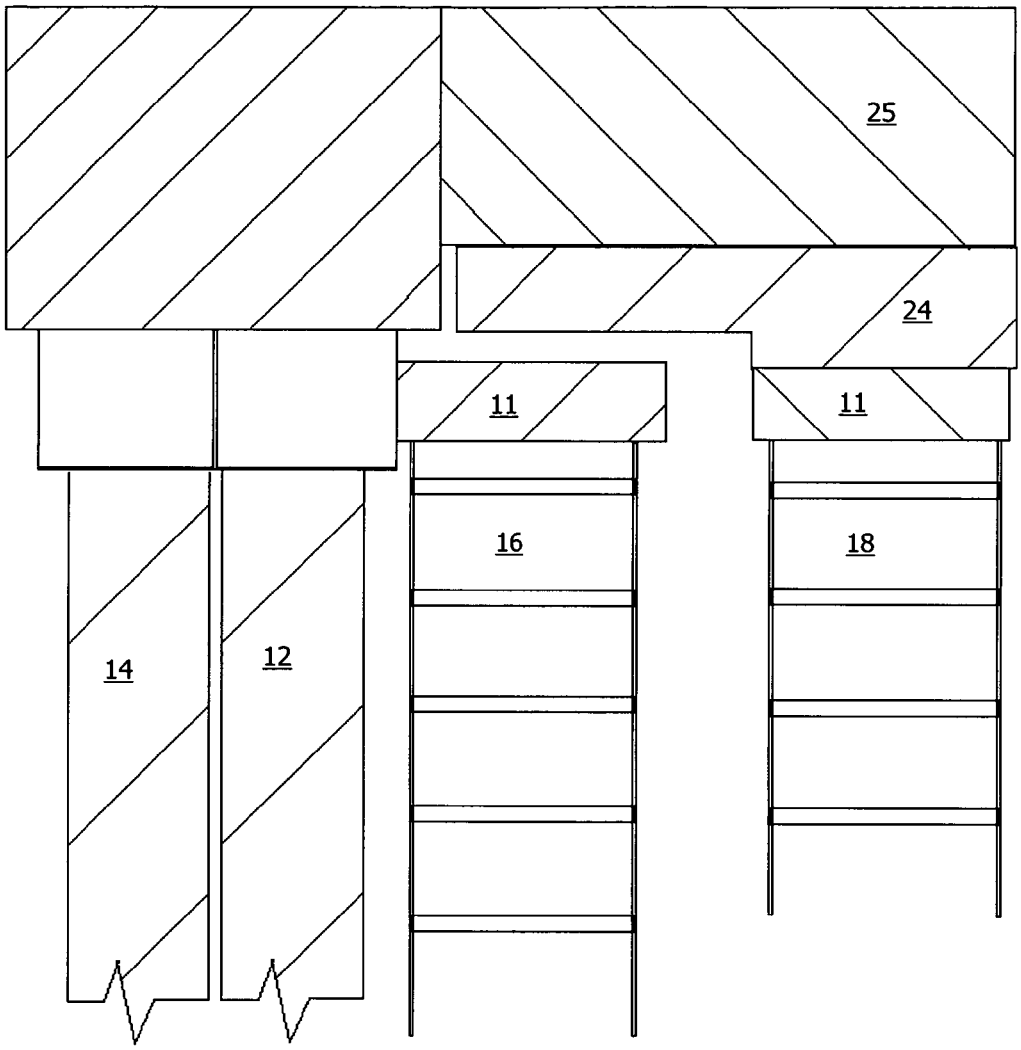
FIG. 7 is a cross sectional end view of the system of FIG. 1.

A header panel 24 is mounted to a fixed structure such as an architrave or lintel above the first and second panels 12, 14. The header panel 24 is shown in FIG. 5. The header panel 24 may extend along the entire length of the first and second panels 12, 14 when the sliding panel 12 is in a closed position. The header panel 24 has a recess 26, formed in its underside. The recess 26 extends the entire length of the header panel 24. The region of the header panel 24 adjacent to the recess 26, on the underside of the header panel 24 provides a mounting surface 28 to which the second blind 18 can mounted with suitable blind support brackets. The system 10 is installed such that the mounting surface 28 is furthest from the first and second panels 12, 14, and the recess 26 permits the first blind 16 to be mounted to the sliding panel 12 at the same height as the second blind 18 which hangs in front of the fixed panel 14. The recess 26 provides a clearance channel for the sliding blind to travel within. As shown in FIGS. 5 and 7 the header panel 24 has a generally "L" shaped profile.

Accordingly, the second blind 18 is secured to the header panel 24, such that it is mounted in front of the first blind 12.

FIG. 7 is a partial cross sectional view of the sliding blind system. As shown in that drawing, the height of the header panel 24 has the effect of setting the height of the fixed, second blind 18. Accordingly, by selecting a suitably sized header panel 24 during installation enables the first and second blinds 16, 18 to be installed at the same height. This helps to create the illusion that there is a single blind covering the entire doorway or window.

In the embodiment described above, the header panel 24 generally covers the entire width of the opening. However, in a second embodiment, the header panel 24 may be provided in the form of a plurality of shorter blocks, which have the same general cross sectional profile as seen in FIG. 7. By making the header panel 24 in three lengths, practically any width of door can be accommodated. When the header panel 24 is made as short blocks, the blocks may be mounted only near each end of the fixed, second blind 18. This second embodiment enables the header panel blocks 24 to be used at each location where the second blind is secured to a blind support bracket 11. This second embodiment negates the need to have the header panel made to a specific size corresponding to the opening. In the second embodiment, a fascia panel may be secured to the front of each of the header panel blocks 24 to create the appearance of a continuous header panel. Alternatively, curtain rod brackets or other such curtain or window dressing mountings may be secured to the header panel blocks 24.

Figure 4:
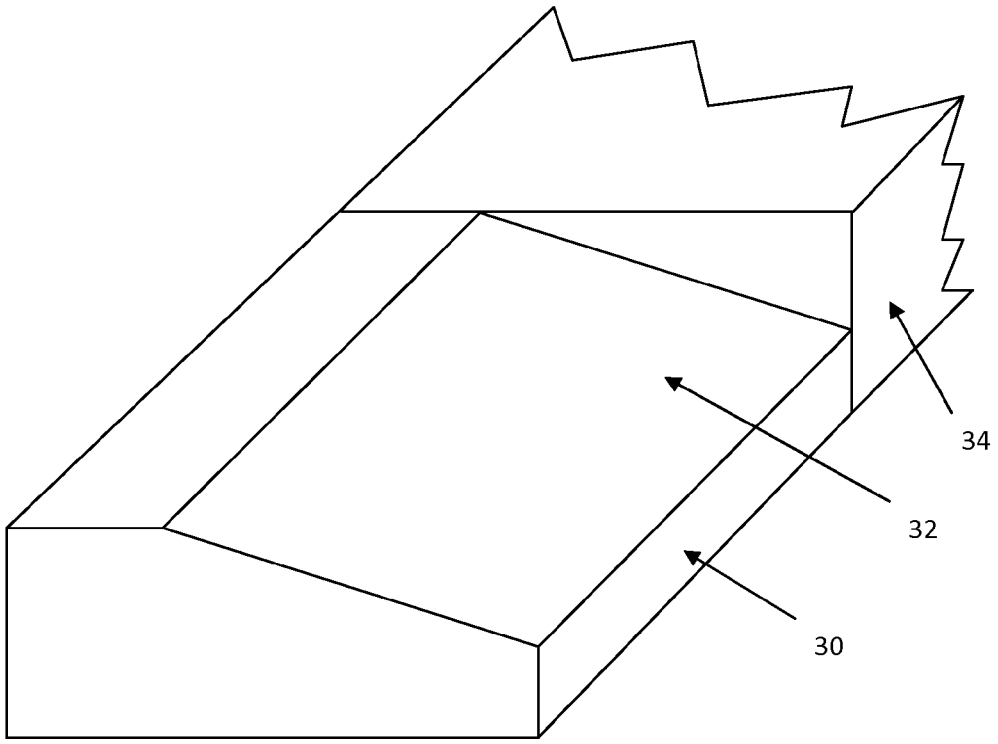
FIG. 4 is a partial perspective view of a footer plate of the sliding door system.

In one embodiment, the sliding blind system 10 also includes a footer panel 30 which is mountable to a floor surface adjacent to the first and second panels 12, 14. The footer panel 30 abuts up against the door frame which supports the panels 12, 14 and the footer panel 30 includes a downwardly tapering run out 32, which reduces the likelihood of a person catching their foot on the footer panel 30 whilst passing through the doorway. The run out 32 is located in front of the doorway when the sliding panel 12 is open and provides a foot plate which both allows smooth entry through the doorway, and protects the door frame from being damaged by kicking. In an alternative embodiment, the entire footer panel 30 has a rectangular profile, similar to the rear portion of the footer panel 30 shown in FIG. 4. It will be appreciated that in instances where the base of the door frame is recessed into the floor, the footer panel 30 is not required.

The footer panel 30 includes a portion 34 which is not tapered. This portion 34 is located adjacent to the fixed panel 14 and enables both of the blinds 16, 18 to be fitted parallel with each other at the bottom. This assists to create an illusion that there is a single venetian blind covering the entire doorway (ie. both panels 12, 14) when both blinds 16, 18 are equally adjusted for light.

Figure 6:
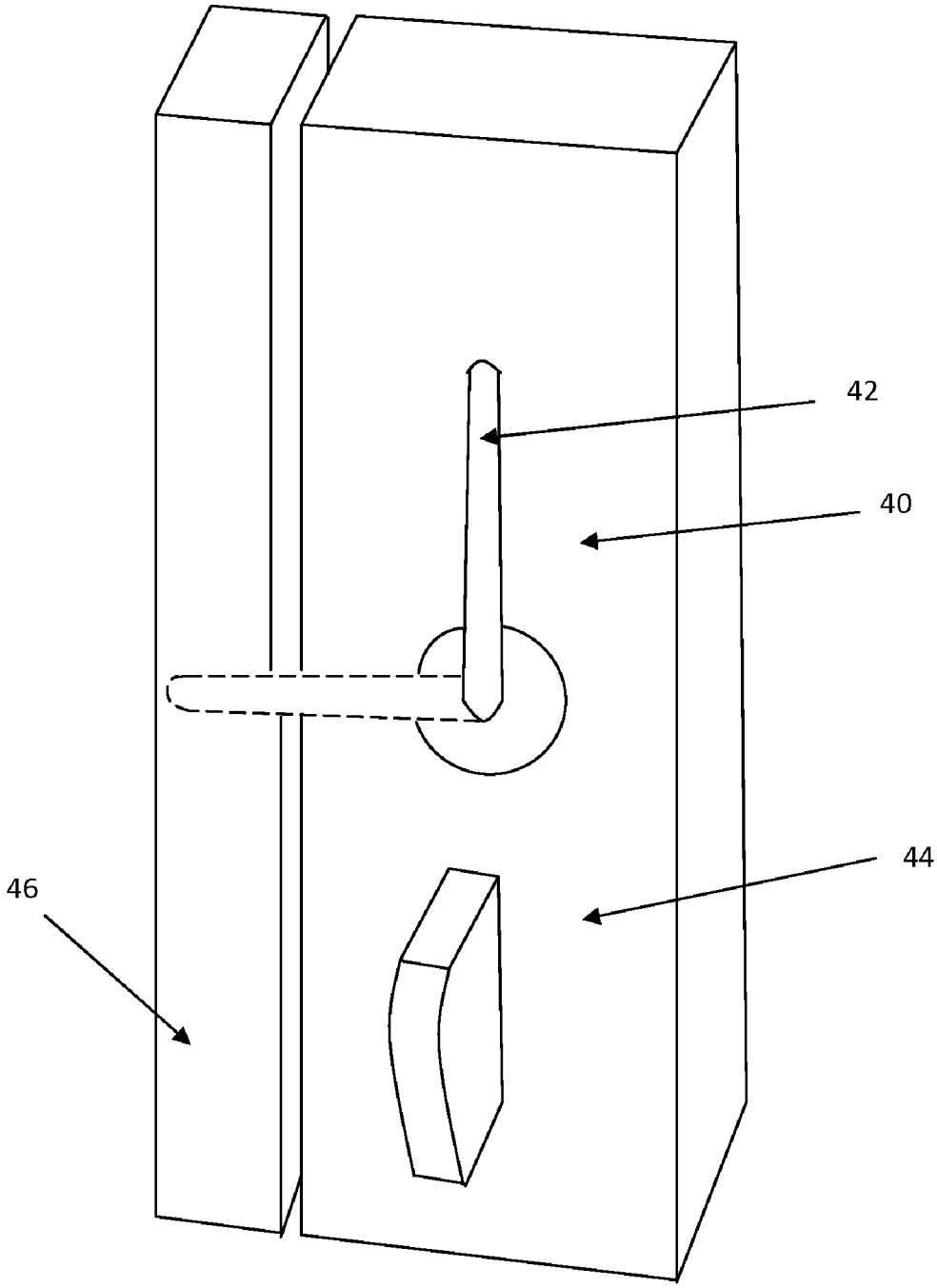
FIG. 6 is a schematic of a modified lock for use with the system.

FIG. 6 shows a modified lock 40 for use with the blind system 10. The lock 40 has a door locking mechanism 44 which is attached to the frame of the sliding panel 12. A door latching mechanism 46 is attached to a door jamb. The latch handle 42 pivots through 90° between locked and unlocked positions as shown in FIG. 6. On account of the angle of movement of the latch handle 42, the modified lock 40 prevents the latch handle 42 from contacting the guide brackets 20, 22, or the blind 16. In addition, the height of the latch handle 42 is sufficient to permit it to slide above the door latch mechanism 46 without contacting it.

An advantage of the system 10 is that the sliding panel 12 can be opened without rolling up the blind 16, which reduces wear on the blind 16.

A further advantage of the system 10 is that it provides the visual appearance of a single blind spanning the entire door way.

A further advantage of the system 10 is that it prevents or greatly reduces the effect of blind sway when the sliding door is opened or closed.

Although the invention has been described with reference to specific examples, it will be appreciated by those skilled in the art that the invention may be embodied in many other forms.

The claims defining the invention are as follows:

1. A sliding blind system for covering a sliding first panel located adjacent to a fixed second panel, said system comprising:

at least one blind support bracket mounted to an upper, generally horizontal edge of said first panel;

a first blind secured to said blind support bracket;

a vertically extending first guide member securable to a generally vertical first side edge of said first panel, and a second vertically extending guide member securable to an opposing generally vertical second side edge of said first panel, wherein said first blind is located generally between said first and second guide members;

a header panel mountable to a fixed structure above said second panel; and a second blind secured to said header panel, wherein said second blind is mounted in front of said first blind such that when said first panel slides in front of said second panel, said first blind slides behind said second blind.

2. The sliding system of claim 1, including a footer panel mountable to a floor surface adjacent to the first and second panels, the footer panel having a downwardly tapering step located adjacent to the first panel when the first panel is closed.

3. The system of claim 2, including a secondary blind support bracket mounted to a lower, generally horizontal edge of said first panel and adapted to secure a base portion of said first blind.

4. The sliding blind system of claim 1, wherein the first and second guide members are formed from sections of 90 degree angle.

5. The sliding blind system of claim 1, wherein the header panel extends above both the first panel and the second panel when the first panel is closed, further wherein the header panel has a recess formed on a side which is closest to said panels, said recess permits the first blind to be mounted at the same height as said second blind.

* * * * *